US005849145A

United States Patent [19]

Tornetti

[11] Patent Number: 5,849,145

[45] Date of Patent: Dec. 15, 1998

[54] DEVICE AND A PROCESS FOR THE CONTINUOUS, WARM SMEARING OF HOTMELT ADHESIVE ONTO A PLASTIC FILM

[76] Inventor: Alberto Tornetti, via Persico, 9, 26043 Battenesco-Persico Dosimo (CR), Italy

[21] Appl. No.: 817,400

[22] PCT Filed: Sep. 18, 1996

[86] PCT No.: PCT/IT96/00178

§ 371 Date: Apr. 16, 1997

§ 102(e) Date: Apr. 16, 1997

[87] PCT Pub. No.: WO97/10900

PCT Pub. Date: Mar. 27, 1997

[30] Foreign Application Priority Data

Sep. 20, 1995 [IT] Italy ..... RM95A0625

[51] Int. Cl.[6] ..... B05C 1/00

[52] U.S. Cl. ..... 156/578; 118/110; 118/245; 118/663; 118/712

[58] Field of Search ..... 156/578; 118/245, 118/246, 249, 262, 110, 111, 114, 117, 712, 663

[56] References Cited

U.S. PATENT DOCUMENTS 4,899,691 2/1990 Fitzgerald, Jr. et al. .

FOREIGN PATENT DOCUMENTS 4013776 10/1991 Germany .
2067101 7/1981 United Kingdom .
WO-9417928 8/1994 WIPO .

*Primary Examiner*—James Engel
*Attorney, Agent, or Firm*—Beveridge, DeGrandi, Weilacher & Young, LLP

[57] ABSTRACT

A device and the related process for the continuous, warm smearing of a thin, hotmelt adhesive layer onto a plastic film (8) to be coupled with a paper support, comprising a blade (1) dosing device for the hotmelt adhesive, with means for adjusting the width of the adhesive strip to be applied as well as the thickness of the same; also comprising a further device for applying the adhesive onto said plastic film, mainly consisting of coupled dispensing roller means (2) and pushing roller means (3); sensor means (5) for bearing and adjusting the detachment position from the dispensing roller means (2) of the smeared film (8), and a device for further spreading and leveling of the film (8) consisting of the coupling of the spreading roller means (4) with pushing roller means (3), wherein the spreading roller means (4) may be possibly artificially cooled down.

13 Claims, 1 Drawing Sheet

DEVICE AND A PROCESS FOR THE CONTINUOUS, WARM SMEARING OF HOTMELT ADHESIVE ONTO A PLASTIC FILM

The present invention concerns a device and the relative process for the continuous, warm smearing of hotmelt adhesive onto a plastic film, that allows the homogenous spreading of a thin adhesive layer onto the films or membranes used for plastic-coating or lining paper objects.

In particular, the device and the process according to the present invention concern the field of plastic-coating of paper industry articles wherein—as already known—the need arises to unite a paper support with a plastic film of different kinds. Usually such film is a polypropylene film, and such film is applied to a paper support by means of interposition of adhesives of different kinds, which all have the purpose of enhancing the paper support, to make it aesthetically more pleasant and to strengthen the surface thereof so that it may better stand the natural deteriorating agents, like dust, humidity, wear, yellowing etc.

Systems for continuous smearing with rolls are already known, which can obtain the spreading of a thin layer of adhesive of different kinds and with different features, onto plastic films.

The employed techologies make use of mainly two particular kinds of processes.

The first one provides for the application of an adhesive compound onto a film that will the be wound into coils, and that may be used a second time in machines for the plastic-coating, by thermic re-activation of the adhesive.

The second process provides for the smearing of the adhesive onto the film directly during the plastic-coating process of the paper support.

The first technology involves the inconvenience that the adhesive film must be stored and transported a plurality of times before use.

Furthermore, it introduces great adhesive waste in the working, because the dimension of the adhesive film, that is smeared over all its width, is not always exactly equal to the one of the supports to be plastic-coated. Finally, the costs of said adhesive films are very high.

The inconveniences of the second process derive from the complexity of the device that manages the smearing and drying process of the adhesive onto the plastic film, and of the following application onto the paper support.

In detail, this second process provides for the use of two fundamental kinds of adhesives: with a solvent base and with watery base.

If adhesives with a solvent base are used, the drying process is quicker because it is favoured by the quick evaporation of the solvent, while causing noxious and polluting gas emissions.

If adhesives with a watery base are used, there are no polluting emissions, but the water evaporation phase is more complex, as it requires more thermic energy, and often the color change of some inks occurs, which are not consistent with the watery base composition of the adhesive.

It is the aim of the present invention to eliminate all above mentioned inconveniences.

The main aim set forth according to the present invention is accomplished by a device that allows the continuously warm smearing of a thin, hotmelt adhesive layer, of the normal or reticulatable kind, commonly used in different fields, especially in paper industry, onto a plastic film by previous spreading and drying of a layer of primer of known kind, with the roller system that may be easily fitted for smearing films of different width without replacing said rollers.

It is a further aim of the present invention by means of a device for the compensation of the thermal expansion between the metal elements of the apparatus, to keep constant the minimum thickness and the dosing of the adhesive according to the variations of the working temperature.

It is another aim of the present invention to introduce a successive phase of spreading and smoothing the plastic film, already smeared with the adhesive.

It is a last aim of the present invention to define a smearing process by means of which the creation of filaments in the adhesive may be avoided, which could compromise the correct and uniform spreading of said adhesive onto the plastic film during the detachment between said film and the smearing roller.

The aims set forth are reached by means of the device and process according to the present invention, as claimed in the enclosed claims, which solves the problem of realizing a device and the relative process for continuous, warm smearing a thin layer of hotmelt adhesive onto plastic films that are to be coupled with a paper support, comprising a blade device for dosing the hotmelt adhesive, with the possibility of adjusting the width of the adhesive strip to be applied as well as its thickness; a successive device for applying the adhesive to the plastic film, mainly consisting of a coupled dispensing and pushing roller; a device for bearing and adjusting the detachment position of the smeared film from the adhesive dispensing roller; a device for further spreading and smoothing of the adhesive film consisting of the coupling between a spreading and a pushing roller, wherein the spreading roller may be possibly cooled down.

The smearing process according to the present invention comprises a first warming and melting phase of the adhesive, e.g. by means of diathermic oil, in a kind of small basin consisting of an inclined blade, resting on an adhesive dispensing roller, closed at its two ends by movable sides which allow the adjustment of the width of the adhesive strip to be smeared onto the film according to the needs, without replacing any element of the device when films of different widths are used.

The dosing of a thin layer of adhesive onto the dispenser roller is therefore realized by means of a device for adjusting the distance between said dosing blade and said dispenser roller, whereby said device is also provided with a device for compensating the thermal expansions of the metal of which the blade and the dispenser roller are made, and which can obtain a fine adjusting of the minimum thickness of the smeared adhesive layer and avoid the contact of two metal surfaces, with the danger of scraping.

Therefore, the application phase of the adhesive to the plastic film takes place by means of the pressure exerted by a rubber roller onto said film against the dispenser roller smeared with adhesive.

Successively, the film is kept into contact with the adhesive dispensing roller for a short distance, even after it has passed the rubber roller, so as to avoid what the sudden detachment causes in the adhesive; the creation of filaments with a following non uniformity in smearing and dispensing of said adhesive.

The position of the loop formed by the film when it gets detached from the dispenser roller, downstream of the contact point with the rubber roller, is controlled by a sensor which, by means of an electronic control, operates onto the motors of the rollers so as to keep the detachment position of said film constant.

Finally, the film may be picked up between the pushing rubber roller (or a second pushing rubber roller) and a further spreading roller, possibly cooled down for improving the features of the anti-adherent material that covers it and which, pushing one against the other, cause an optimal spreading and smearing of the adhesive film before the latter is led to the coupling phase with the paper support to be covered.

For making the film's surface fit for the smearing process with hotmelt adhesive, reducing the quantity of needed adhesive or allowing the use of cheaper adhesives, it is sufficient to use films that are previously smeared with a primer of known kind by means of a spreading and drying process realized with known systems, before the smearing process with hotmelt adhesive as described by the present invention.

The advantages obtained by means of the present invention mainly consist in that the smearing costs are reduced, the adhesive waste is reduced, air polluting problems or noxious gas emissions in a working room are avoided, the color change problems are overcome and a final result in brillant colours is obtained which are equal or even superior to the one of the technologies that make use of the conventional watery or solvent adhesives.

Further features and advantages of the present invention will be described hereinbelow relating to the enclosed drawings in which a preferred embodiment of the device according to the present invention is shown.

Figure 2:
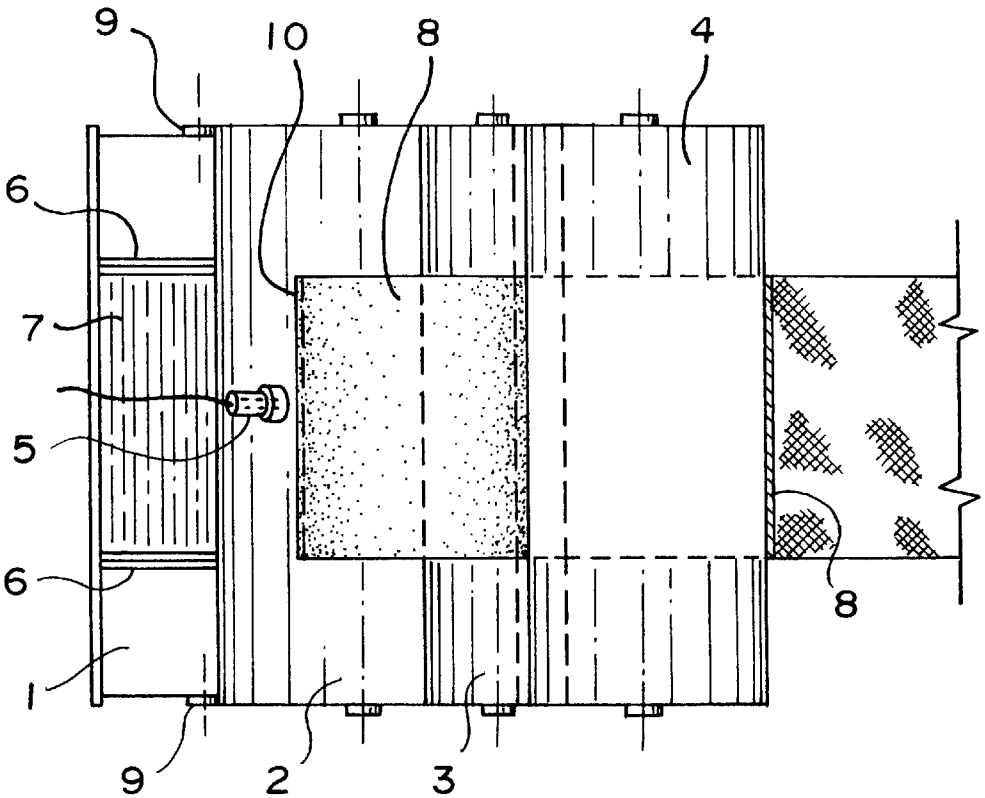
FIG. 2 shows a top view of the same device according to the present invention.
Figure 1:
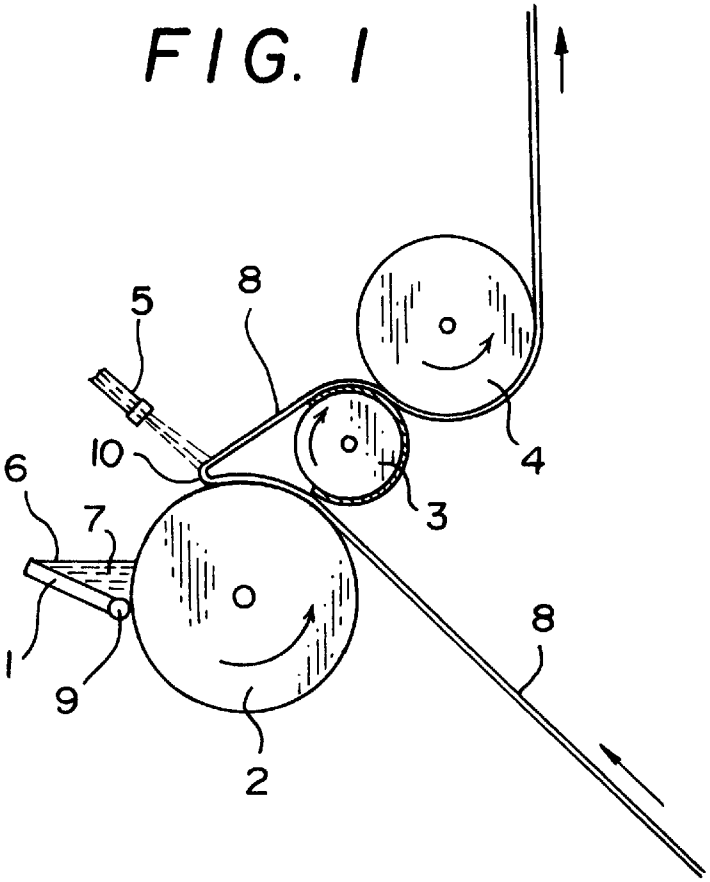
FIG. 1 shows a lateral view of a device for the warm smearing of adhesive onto a plastic film, according to the present invention.

Relating now to the details shown in the enclosed drawings, the present invention consists of a device and the relative process for performing the warm, continuous smearing of hotmelt adhesive onto plastic films, mainly comprising:

a blade 1;
dispensing roller means 2;
pushing roller means 3;
spreading roller means 4;
sensor means 5.

In a preferred embodiment according to the present invention, a blade 1 and the dispensing roller means 2 form, with the movable, shaped walls 6, a kind of small containing basin for the adhesive 7, kept melted by the heat transmitted by said blade 1 as well as by said roller means 2, in turn heated by known systems, e.g. with diathermic oil or by electric resistances or with warm air or water, radiation lamps etc., according to the maximum temperature bearable by said plastic film 8 to be smeared.

The adhesive 7 is continuously fed to the containing basin through a known filling up and heating device, for replacing the product taken from said basin during the working phase.

The two movable shaped walls 6 are applied to the blade 1 by sliding block links, which allow them to slide in a direction parallel to the axis of the dispensing roller means 2 so that their position may be appropriately adjusted by the user so as to allow the spreading of the adhesive 7 onto the roller means 2 only for the requested width. If the elements of the device are dimensioned for a larger film, one and the same smearing device can be used as well as for thinner films, by a simple adjusting of the position of walls 6.

A device fixed onto blade 1, maily consisting of bearings 9 put into contact with the roller means 2, provided with devices for eccentric adjusting, can set out and keep constant the distance between the smearing blade of said blade 1 and the roller means 2, relating to the quantity of adhesive that is to be smeared onto the plastic film 8, balancing the thermal expansions of the metal elements 1 and 2, for avoiding the result that the two metal surfaces may get into contact, thus causing stripes and scrapings on the roller means 2.

The dispensing roller means 2 rotate between the blade 1 and the pushing roller means 3, comprising at least one rubber sheathed roller, which have the purpose of contacting the plastic film 8 with the external surface of the dispensing roller means 2, covered with adhesive.

Said pushing roller means 3 are in contact also with spreading roller means 4, covered with anti-adherent material, like teflon, and possibly internally cooled for exalting its anti-adherent features towards the adhesive smeared onto the plastic film, for spreading and levelling the adhesive onto said film 8 and pulling it towards the following working.

Appropriate support and moving devices for said roller means 2 and 3, mainly consisting of bearings and lever systems moved by pneumatic mechanisms of known kind, allow the opening thereof for inserting the initial part of said plastic film 8, as well as the rotation for the pulling of said film.

In a further embodiment of the device according to the present invention, the pushing roller means 3 comprise two rubber sheathed rollers respectively pushing against the dispensing roller means 2 and against the spreading roller means 4.

The real continuous smearing process of the hotmelt adhesive 7, of the known or reticulatable kind, onto said plastic film 8, provides the translation of the adhesive onto said film by means of the pressure of said roller means 3 onto said film 8 against the surface of the roller means 2, previously spread with adhesive by means of said blade 1.

However, said film 8, after having passed the contact point between the two roller means 2 and 3, is not immediately detached from the surface of the roller means 2, but keeps the contact therewith for a short distance, downstream of the resting line between the roller means 2 and 3, without the pressure of the pushing roller means 3 exploiting the adhesive capacity of adhesive 7, so as to realize a small loop 10 between the surface of said roller means 2 and the sliding direction of said film 8.

The position of said loop 10 is borne by sensor means 5 which, through an apposite electronic card for the control and managing of the movements, can modify the relative rotation speed of the roller means 2, 3 and 4 so as to maintain constant the shape and the position of said loop.

The keeping of said distance of further contact as well as the realization of said loop 10 are fundamental for avoiding filaments and for obtaining a good smearing uniformity of the film's 8 surface.

According to a possible variant of the device according to the present invention, said blade 1 may be replaced by roller means that perform the same function of dosing and spreading, said adhesive 7. Said roller means may be of a fixed size and that may be replaced from time to time according to the width of the film to be smeared, or they may also be provided with movable walls for the width of the film to be smeared.

According to another embodiment of the device according to the present invention, said roller means 4 may be detached from said pushing roller means 3 and will therefore be provided with a different, suitable pulling and levelling system of said film of a known kind, e.g. a depression system.

I claim:

1. A device for the continuous, warm smearing of hotmelt adhesive onto a plastic film comprising a heated dosing means for dosing the adhesive;

heated dispensing roller means opposite said dosing means onto which the adhesive is dosed by said dosing means;

pushing roller means pressing against said dispensing roller means for pushing said film through a first nip between itself and said dispensing roller means as adhesive is smeared onto said film;

spreading roller means for spreading said smeared adhesive on said film; and sensor means which detects a loop formed between said first nip and said pushing roller means at the point where said film is pulled from said dispensing roller means.

2. The device as defined in claim 1 wherein said dosing means is a blade.

3. The device as defined in claim 2 further comprising movable shaped walls adjacent said blade;

said walls having an adjusting means for moving said walls in a direction parallel to an axis of said dispensing roller means, for adjusting the width of said walls, and for consequently controlling the width of said adhesive spread onto said dispensing roller means.

4. The device according to claim 3 further comprising bearings fixed onto said blade which contact said dispensing roller means; and eccentric means for adjusting the distance between said dispensing roller means and for consequently controlling the quantity of adhesive that is smeared onto said film.

5. The device as defined in claim 1 wherein said pushing roller means comprises at least one rubber sheathed roller for contacting said film having adhesive smeared thereto with a surface of said spreading roller means.

6. The device as defined in claim 1 wherein said pushing roller means contacts said spreading roller means; and wherein said spreading roller means pulls said film off of said dispensing roller means and through a second nip between itself and said pushing roller means while smoothing said smeared adhesive on said film.

7. The device as defined in claim 1 further comprising a cooling means for cooling said spreading roller means;

wherein a surface of said spreading roller means comprises an anti-adherent material.

8. The device as defined in claim 1 wherein said sensor means further comprises an electronic control means for controlling a shape and position of said loop and for modifying a relative rotational speed among said dispensing roller means, said pushing roller means, and said spreading roller means.

9. The device as defined in claim 1 wherein said dosing means is a fixed or adjustable roller means for containing said adhesive between said fixed or adjustable roller means and said dispensing roller means.

10. The device as defined in claim 1 further comprising a pulling means for pulling said film off of said dispensing roller means;

wherein said pushing roller means does not contact said spreading roller means.

11. The device as defined in claim 10 wherein said pulling means is a depression system.

12. A process for the continuous warm smearing of hotmelt adhesive onto a plastic film comprising dosing said adhesive onto a dispensing roller means; smearing said dosed adhesive onto said film by passing said film between a first nip formed by said dispensing roller means and a pushing roller means;

detaching said film from the surface of said dispensing roller means by pulling said film between a second nip formed by said pushing roller means and a spreading roller means after said film has traveled a predetermined distance along the surface of said dispensing roller means beyond said first nip;

smoothing said smeared adhesive as said film passes through said second nip;

wherein a loop is formed by said film between said first and second nips the size of which loop is controlled by sensor means which detects the end of said loop at said predetermined distance.

13. A process for the continuous warm smearing of hotmelt adhesive onto a plastic film comprising dosing said adhesive onto a dispensing roller means; smearing said dosed adhesive onto said film by passing said film between a nip formed by said dispensing roller means and a pushing roller means;

detaching said film from the surface of said dispensing roller means by pulling said film from a spreading roller means after said film has traveled a predetermined distance along the surface of said dispensing roller means beyond said nip;

smoothing said smeared adhesive as said film passes over said spreading roller means;

wherein a loop is formed by said film between said nip and said pushing roller means, the size of which loop is controlled by sensor means which detects the end of said loop at said predetermined distance.

* * * * *